United States Patent [19]

Sheppard et al.

[11] Patent Number: 4,720,287

[45] Date of Patent: Jan. 19, 1988

[54] LOW TEMPERATURE THERMAL-CHEMICAL PRETREATMENT PROCESS FOR PEAT DEWATERING

[75] Inventors: John D. Sheppard, Montreal; David G. Cooper, Dollard-des Ormeaux, both of Canada

[73] Assignee: Canadian Patents and Development Ltd., Ottawa, Canada

[21] Appl. No.: 891,316

[22] Filed: Jul. 13, 1986

[30] Foreign Application Priority Data

Aug. 29, 1985 [CA] Canada ..... 489711

[51] Int. Cl.[4] ..... C10L 9/02; C10F 7/06

[52] U.S. Cl. ..... 44/33; 44/27; 34/9; 435/267

[58] Field of Search ..... 44/27, 32, 33, 1 D, 44/1 G; 34/9; 435/267

[56] References Cited

U.S. PATENT DOCUMENTS 4,206,288 6/1980 Detz et al. ..... 44/1 SR

FOREIGN PATENT DOCUMENTS 518597 11/1955 Canada ..... 44/33
WO83/02228 7/1983 PCT Int'l Appl. ..... 44/33
717122 2/1980 U.S.S.R. ..... 44/32

*Primary Examiner*—Carl F. Dees
*Attorney, Agent, or Firm*—Alan A. Thomson

[57] ABSTRACT

This invention concerns dewatering peat by heating it and subjecting it to a surface active agent, preferably a cationic polymeric surface active agent and subsequently pressing the product to yield a peat product with lowered moisture content.

17 Claims, 4 Drawing Figures

PROCESS FLOW DIAGRAM

LOW TEMPERATURE THERMAL-CHEMICAL PRETREATMENT PROCESS FOR PEAT DEWATERING

Figure 1:
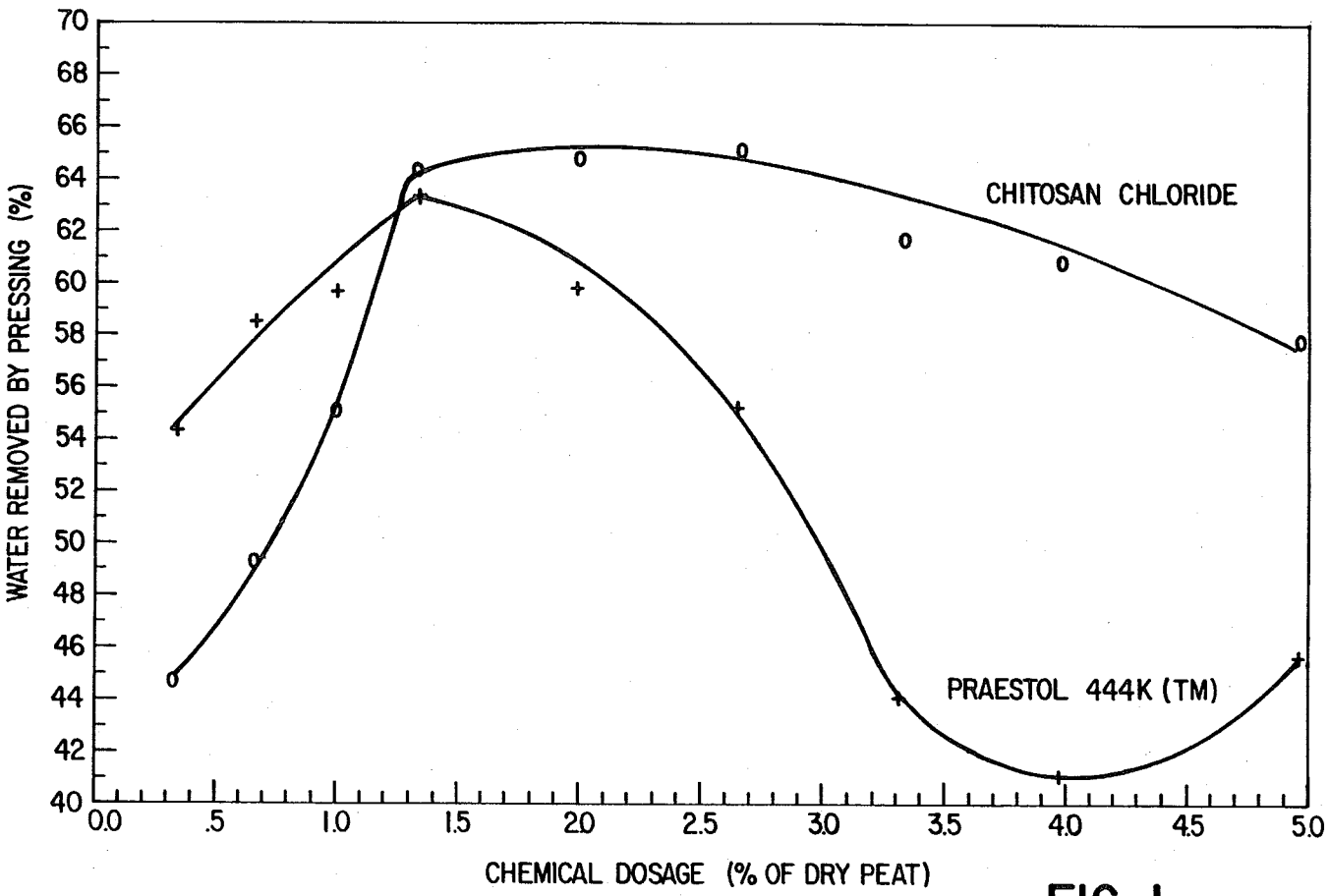

This invention is concerned with means for dewatering peat. There are vast resources of peat available in North America and around the world but, to date, limited use has been made of these resources for fuel for a variety of reasons, most of which are connected with the cost of the final product after processing when compared to other sources of fuel. A major problem associated with the use of peat as a fuel is that of dewatering.

Where pretreatment of peat or peat slurry prior to mechanical dewatering is simply thermal, the desired temperature is high, usually about 200° C. and, in the case of wet carbonization, strong wastewater streams result. In addition, the processes are capital intensive due to the requirement of high pressure equipment. Significant amounts of product are not recovered as a result of dissolution and overall energy efficiencies can be low. As a result, many techniques have been devised in an effort to reduce the temperature required in the pretreatment step.

Canadian Pat. No. 155,425, (inventor, F. A. Buckle), describes the use of an electric current in conjunction with a temperature of at least about 100° C. and a pressure sufficient to prevent steam forming. Canadian Pat. No. 159,904 (inventor, Thomas Rigby) concerns the use of heat followed by pressing at a relatively high temperature with the hot liquid matter recycled to enhance the reaction and assist in the retention of nitrogen in the solid matter. Canadian Pat. No. 164,844 (inventor, Thomas Rigby) concerns the use of heat and increased pressure followed by suction through a filtering surface in the production of dewatered peat. This patent does not employ added chemicals. Canadian Pat. No. 518,597 (inventor, K. N. Cederquist) is concerned with a partial carbonization of peat at elevated temperatures and pressures followed by removal of liquid matter. Canadian Pat. No. 164,595 (inventors, T. Rigby and G. W. Andrews) is concerned with pretreating peat with mineral acid prior to treatment at temperatures around 100° C. and subsequent dewatering. Canadian Pat. No. 195,549 concerns the use of inorganic salts, such as calcium chloride, to enhance mechanical dewatering of peat. The applicant, Bouillar, states that calcium chloride has the property of reducing intracellular water. To our knowledge, none of these methods is being commercially exploited.

Any new method for dewatering peat should preferably address at least the following problems, which are incompletely addressed by the prior art: (1) the use of high temperatures and pressures and the capital costs associated therewith, (2) strong wastewater streams, (3) high solubilization of peat associated with some treatments, (4) improved efficiency in mechanical pressing of the treated peat product.

This invention has the object of obviating these problems and concerns a process for dewatering peat comprising (a) heating and subjecting peat to a compound such as selected chitosan salts, esters of polyaminocarbonic acids, dodecyltrimethylammonium bromide, xanthan gum or surfactin to render peat more amenable to mechanical dewatering;

(b) mechanically dewatering the product of step (a) to yield a peat product with lowered moisture content.

This process may comprise heating peat in the presence of a thermally stable surface active agent, preferably a cationic polymer. Particularly useful thermally stable surface active agents have been found among chitosan salts, especially chitosan chloride.

Step (a) of the process may alternatively comprise (i) heating peat and then (ii) subjecting the product of (i) to a surface active agent. In such a process variant the surface active agent is preferably cationic, especially a cationic polymer, particularly one selected from a chitosan salt and esters of polyaminocarbonic acids.

In the above-referenced process and variants thereof the peat is preferably heated to between 100° and 150° C. 125° C. has been found to be a particularly useful operating temperature. The heating step is preferably completed in between 1 and 20 minutes.

The amount of surface active agent employed in such a process and process variants is preferably between 0.5% and 2.5% of the dry weight of the peat being processed.

Preferred embodiments of the process comprise (a) (i) heating peat to about 125° C. in about 10 minutes and then (ii) subjecting the product of (i) to about 1.3% of the dry weight of peat of chitosan chloride or an ester of a polyaminocarbonic acid (e.g. Praestol 444K (TM)), and (b) mechanically pressing the product of step (a) (ii) for the equivalent of about 3 minutes at 20 atmospheres whereby a peat product with lowered moisture content is obtained.

In another embodiment of the process step (a) comprises heating peat and subjecting peat to a biologically produced surface active agent capable of rendering peat more amenable to mechanical dewatering. Such a biologically produced surface active agent may be produced by a surface active agent producing organism selected from the group consisting of *Xanthomonas campestris*, especially of the ATCC 13951 type, *Bacillus subtilis* and *Rhizopus arrhizus*. Preferably such organisms should be cultured in a medium wherein at least 60% of water requirements is water that has run through peat, such water being derived either from mechanical dewatering of peat or a peat bog or from a thermal or chemical treatment of peat.

A particular process for dewatering peat comprises: (a) heating peat, preferably to about 125° C., and subjecting peat to a biologically produced surface active agent capable of rendering peat more amenable to mechanical dewatering means, said biologically produced surface active agent being produced by an organism of the *Rhizopus arrhizus* type, said organism being continuously cultured in a suitable medium in which at least 60% of water requirements is water which has run through peat, preferably some of which water results from mechanical dewatering of peat; (b) mechanically dewatering the product of step (a) to yield a peat product with lowered moisture content.

A further aspect of this invention concerns a method of enhancing the production of a biologically produced surface active agent from an organism of the *Xanthomonas campestris* ATCC 13951 type or of the *Rhizopus arrhizus* ATCC 58106 type comprising culturing said organism in a suitable medium in which at least 60% of water requirements is water which has run through peat, such as a peat bog, or is water which results from mechanical pressing of peat or from a thermal or chemical treatment of peat.

Figure 2:
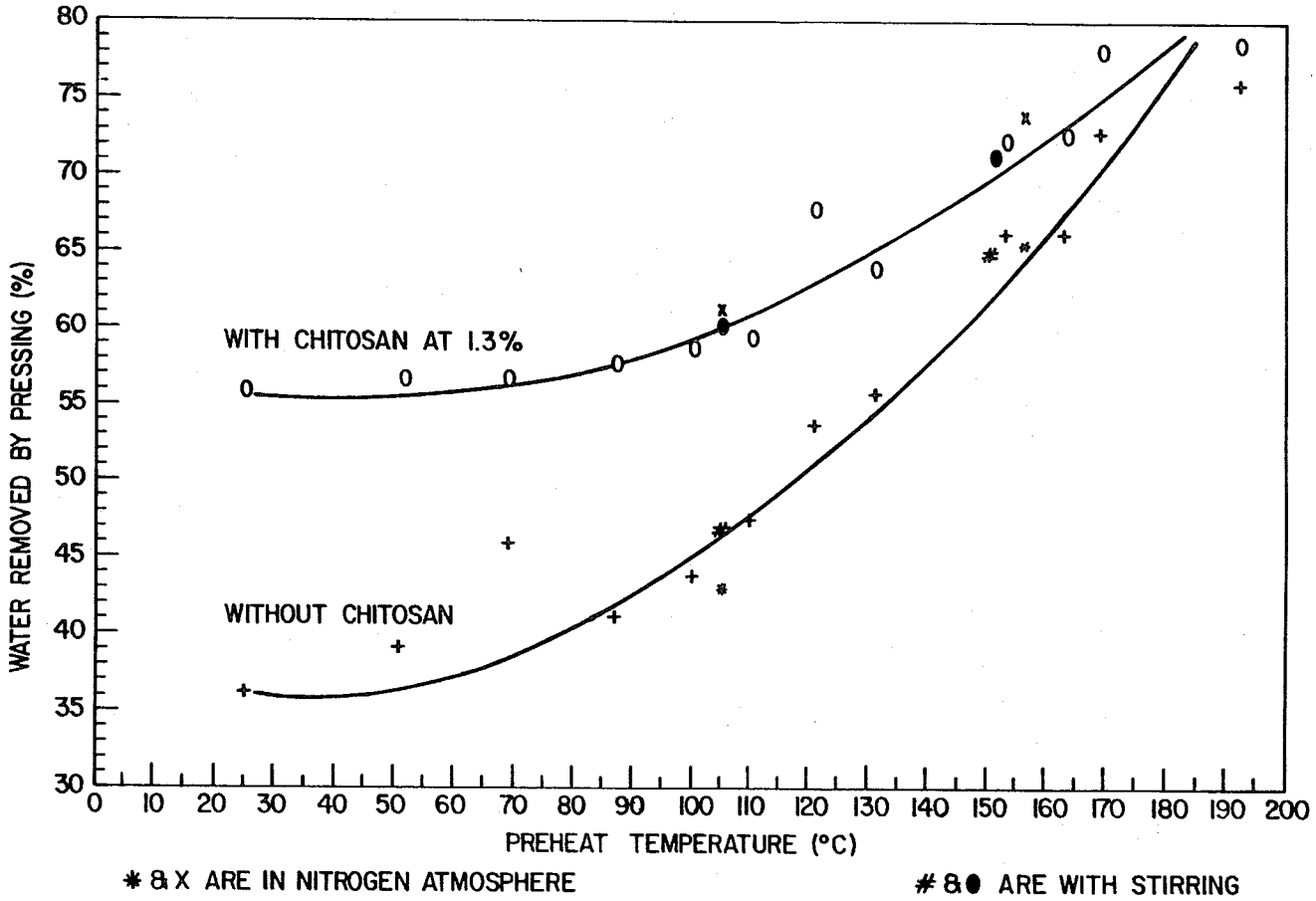
Figure 3:
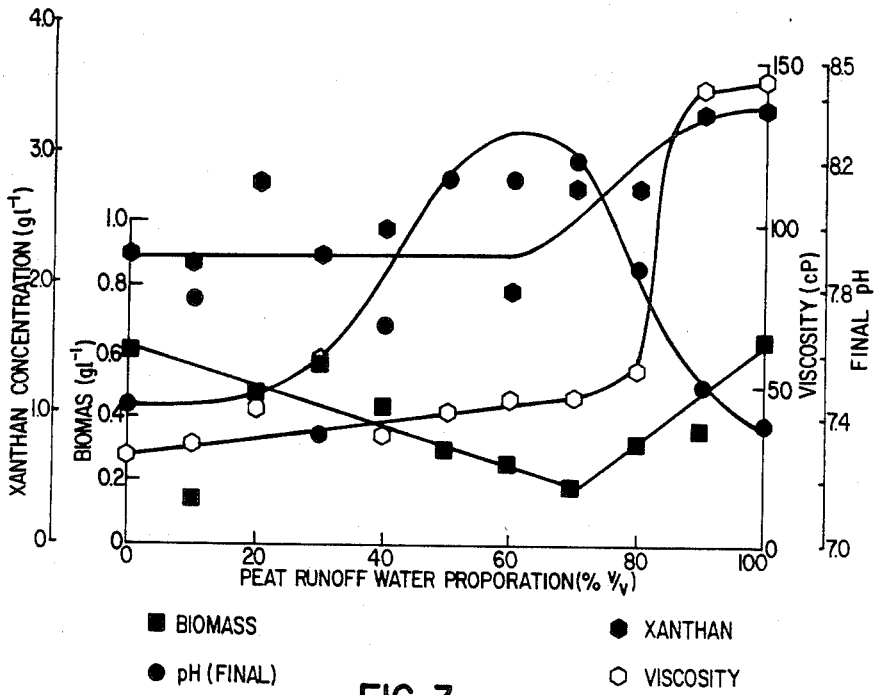

In the drawings which illustrate embodiments of this invention,

FIG. 1 shows graphs relating water removed by pressing to chemical dosage of chitosan chloride or an ester of a polyaminocarbonic acid (Praestol 444K(TM)), FIG. 2 relates water removed by pressing to preheat temperature, FIG. 3 relates the amount of the biological polymer, xanthan gum, produced by *Xanthomonas campestris* ATCC 13951 grown on YM medium to different proportions of peat runoff water. In FIG. 3, the solid squares represent plots of biomass produced, the solid circles represent plots of the final pH achieved, the solid hexagons represent plots of the xanthan gum produced and open hexagons represent viscosity.

Figure 4:
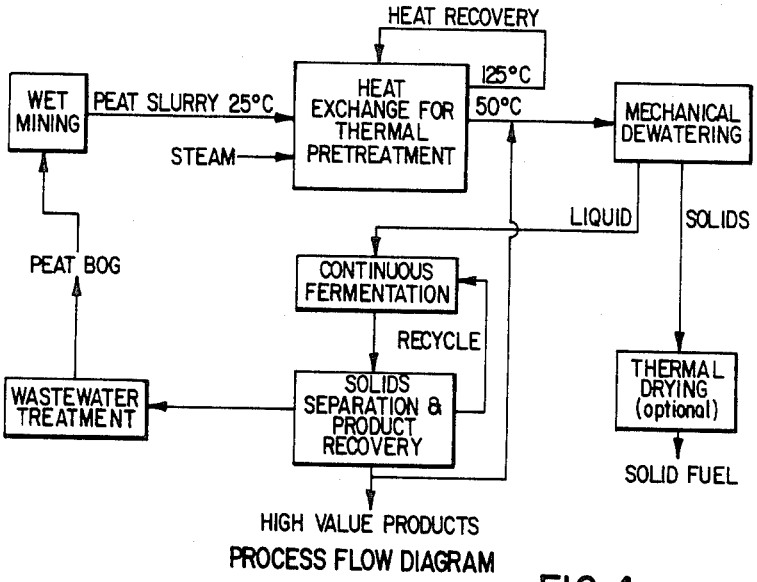

FIG. 4 shows a process flow diagram for dewatering peat and the production of a biological surface active agent or polymer.

EXAMPLE 1

A series of experiments was performed on von Post of H9 peat, a peat considered to be difficult to dewater but recommended for use as a fuel due to its high calorific value. Varying proportions of chitosan chloride and Praestol 444K (TM), an ester of a polyaminocarbonic acid, were mixed with the peat in a ball mill for about 5 minutes at room temperature. The treated peat was pressed for 3 minutes at 19.5 atmospheres.

The results, shown in table 1 and FIG. 1, indicate that the preferred proportions of both compounds appear to be about 1.3% of the peat dry weight and these results were used in subsequent experiments.

TABLE 1

Effect of Chemical Dosage on Dewatering

| Additive | Weight (g) | % of peat dry weight | % moisture content of pressed peat* | % water removed by pressing |
|---|---|---|---|---|
| Control | — | — | 83.2 | 32.1 |
| Chloride salt of chitosan | 0.01 | 0.33 | 80.1 | 44.7 |
| | 0.02 | 0.66 | 78.7 | 49.2 |
| | 0.03 | 0.99 | 76.6 | 55.0 |
| | 0.04 | 1.32 | 72.1 | 64.3 |
| | 0.06 | 1.98 | 71.9 | 64.8 |
| | 0.08 | 2.64 | 71.8 | 65.1 |
| | 0.10 | 3.31 | 73.6 | 61.7 |
| | 0.12 | 3.97 | 74.0 | 60.9 |
| | 0.15 | 4.96 | 75.5 | 57.8 |
| Praestol 444K [TM] | 0.01 | 0.33 | 76.9 | 54.3 |
| | 0.02 | 0.66 | 75.1 | 58.5 |
| | 0.03 | 0.99 | 74.6 | 59.6 |
| | 0.04 | 1.32 | 73.3 | 63.3 |
| | 0.06 | 1.98 | 74.6 | 59.8 |
| | 0.08 | 2.64 | 76.5 | 55.2 |
| | 0.10 | 3.31 | 80.3 | 44.1 |
| | 0.12 | 3.97 | 81.1 | 41.1 |
| | 0.15 | 4.96 | 79.8 | 45.7 |

*25 g of peat at 87.9% moisture content pressed for 3 minutes at 19.5 atm.

EXAMPLE 2

A second series of experiments was performed on von Post of H9 peat. A variety of preheat temperatures were used with and without subsequent addition of 1.3% chitosan chloride. The procedure employed was to heat the vessel up to the temperature indicated and then cool it by immersion in water. It took about 10 minutes to reach 100° C. and about 20 minutes to reach the higher temperatures. Following cooling, the treated peat was pressed for 3 minutes at 19.5 atmospheres.

The results are shown in FIG. 2 and in table 2 where dewatering is represented in two different ways (percent moisture of pressed peat and percentage of water removed by pressing). Percentage of water removed by pressing can sometimes be more useful since starting moisture contents of peat can vary. As indicated, the use of a nitrogen atmosphere or stirring did not appear to have any significant effect.

TABLE 2

Data from Pressing of Preheated Peat

| Preheat Temperature (°C.) | % moisture content of pressed peat* | | % water removed by pressing | |
|---|---|---|---|---|
| | no chitosan chloride | +1.3% chitosan chloride | no chitosan chloride | +1.3% chitosan chloride |
| 25 | 82.4 | 76.4 | 36.2 | 55.8 |
| 51 | 81.7 | 76.1 | 39.1 | 56.6 |
| 69 | 79.9 | 76.1 | 45.8 | 56.6 |
| 87 | 81.2 | 75.6 | 41.1 | 57.7 |
| 100 | 80.5 | 75.1 | 43.7 | 58.9 |
| 110 | 79.4 | 74.8 | 47.4 | 59.5 |
| 121 | 77.3 | 70.2 | 53.6 | 67.9 |
| 131 | 76.5 | 72.5 | 55.6 | 64.0 |
| 153 | 71.3 | 66.9 | 66.1 | 72.4 |
| 163 | 71.3 | 66.5 | 66.1 | 72.9 |
| 169 | 66.6 | 61.4 | 72.8 | 78.3 |
| 192 | 63.9 | 60.9 | 75.9 | 78.8 |
| In nitrogen atmosphere | | | | |
| 105 | 80.7 | 74.0 | 43.0 | 61.2 |
| 156 | 71.6 | 65.5 | 65.6 | 74.1 |
| With stirring | | | | |
| 105 | 79.6 | 74.5 | 46.8 | 60.2 |
| 151 | 71.8 | 66.7 | 65.3 | 71.4 |

*25 g of peat at 87.9% moisture content pressed for 3 minutes at 19.5 atm.

EXAMPLE 3

A comparison was made of a biosurfactant (a lipopeptide) produced by *Bacillus subtilis*, chitosan chloride (a cationic biopolymer produced by protonating chitosan with hydrochloric acid) and Praestol 444K (TM), an ester of a polyaminocarbonic acid. Peat was heated to 125° C. for 20 minutes and the additive then added. The peat-additive mixture was subsequently pressed at 19 atmospheres for 2.5 minutes and the results are shown in table 3. As can be seen the combined effect of heating and additive treatment reduced the water-content significantly.

TABLE 3

Additive/% moisture content of peat after pressing at 19 atm for 2.5 minutes

| | No heating | Heating at 125° C., 20 min |
|---|---|---|
| Control (no additives) | 78–80 | 69–70 |
| Biosurfactant (0.079 g/g peat) | 73–75 | 63–65 |
| Chitosan chloride (0.0024 g/g) | 71 | 61 |
| Praestol 444K [TM] (0.0024 g/g) | 71 | 66 |

These results indicate that heating peat to between 100° C. and 150° C. in about 10 minutes, subsequently cooling and treating with a suitable surfactant or polymer can be recommended as a pretreatment process for dewatering peat. Higher temperatures involve greater expense and, as can be seen from FIG. 2, there is no corresponding benefit.

EXAMPLE 4

*Xanthomonas campestris* can be used as a source of the polymer xanthan gum. Yields of xanthan can be dramatically increased by employing peat run-off water in YM medium.

*Xanthomonas campestris* ATCC 13951 was grown on YM broth with various proportions of distilled water and filtered peat run-off water collected from a peat bog. The YM broth contained yeast extract (3 g/l), malt extract (3 g/l), peptone (5 g/l) and dextrose (10 g/l) and is the preferred medium for high yield xanthan production. All fermentations were conducted at 24° C. for 2–5 days. As may be seen from FIG. 3, there is a dramatic increase in final xanthan concentration and medium viscosity when the proportion of peat run-off water was higher than 60%.

It should be noted that not all strains of *Xanthomonas campestris* appear to respond in this fashion to filtered peat run-off water, and the extent of the effects of peat run-off water are dependent on the fermentation medium used.

Other organisms producing surface active agents or biopolymers, can be grown on peat and/or peat water. These include *Aureobasidium pullulans, Bacillus subtilis* and *Rhizopus arrhizus.*

The above results lead to the development of a flow sheet for the dewatering of peat in conjunction with culturing of such an organism, especially *Rhizopus arrhizus* (see FIG. 4). In this system, peat is wet mined and thermally pretreated to about 125° C. before being passed through heat exchange means (to heat incoming peat), mixed with a biologically produced surfactant before mechanical dewatering and a subsequent, optional, thermal drying step. The liquid extract from mechanical dewatering is partially or wholly diverted to a continuous fermentor containing such an organism especially one of the *Rhizopus arrhizus* ATCC 58106 type. The by-products of the fermentor are partially diverted for use in the peat dewatering process (biosurfactants). Other high value products (e.g. polymers) may be produced and wastewater may optionally be diverted back to a peat bog.

We claim:

1. A process for dewatering peat comprising:
   (a) heating and subjecting peat to a surface active agent, selected from the group consisting of a chitosan salt of a mineral acid, dodecyltrimethylammonium bromide, and biologically produced surface active agents being produced by an organism selected from the group consisting of *Xanthomonas campestris, Bacillus subtilis, Rhizopus arrhizus* and *Aureobasidium pullulans,* to render peat more amenable to mechanical dewatering; and
   (b) Mechanically dewatering the product of step (a) to yield a peat product with lowered moisture content.

2. The precess of claim 1 wherein step (a) comprises heating peat in the presence of a thermally stable surface active agent, said surface active agent being selected to be stable up to the temperature attained by such heating.

3. The process of claim 2, wherein the thermally stable surface active agent is a chitosan salt of a mineral acid.

4. The process of claim 3 wherein the chitosan salt is chitosan chloride.

5. The process of claim 1 wherein step (a) comprises (i) heating peat and (ii) subjecting the product of (i) to a surface active agent.

6. The process of claim 1 wherein peat is heated to between 100° C. and 150° C.

7. The process of claim 1 wherein peat is heated to about 125° C.

8. The process of claim 1 wherein the heating step is completed within 1 to 20 minutes.

9. The process of claim 1 wherein the amount of surface active agent is between 0.5% and 2.5% of the dry weight of the peat being processed.

10. The process of claim 5 wherein the surface active agent is selected from the group consisting of chitosan chloride, chitosan sulphate, and dodecyltrimethylammonium bromide.

11. The process of claim 5 wherein step (a) comprises (i) heating peat to about 125° C. in about 10 minutes and then (ii) subjecting the product of (i) to about 1.3% of the dry weight of peat of chitosan chloride, and step (b) comprises mechanically pressing the product of step (a) (ii) for the equivalent of about 3 minutes at 20 atmospheres whereby a peat product with lowered moisture content is obtained.

12. The process of claim 1 wherein stap (a) comprises heating peat and subjecting peat to a bilogically produced surface acive agent capable of rendering peat more amenable to mechanical dewatering, said biologically produced surface active agent being produced by an organism selected from the group consisting of *Xanthomonas campestris, Bacillus subtilis, Rhizopus arrhizus* and *Aureobasidium pullulans.*

13. The process of claim 12 wherein the organism is of the *Rhizopus arrhizus* ATCC 58106 type.

14. The process of claim 12 wherein the orgamism is cultured in a medium wherein at least 60% of water requirements is water which has contacted peat.

15. The process of claim 14 wherein some of the medium's water requirement is water selected from that derived from mechanical dewatering of peat, that which has run through a peat bog, and that resulting from thermal or chemical treatment of peat.

16. The process of claim 12 wherein step (a) comprises heating peat to about 125° C. and subjecting peat to a biologically produced surface active agent capable of rendering peat more amenable to mechanical dewatering means, said biologically produced surface active agent being produced by an organism of *Rhizopus arrhizus* ATCC 58106 type, said organism being continuously cultured in a suitable medium wherein at least 60% of water requirements is water which has contacted peat.

17. The process of claim 3 wherein the chitosan salt is selected from the group consisting of chitosan chloride and chitosan sulphate.

* * * * *